US010213792B2

(12) United States Patent
Eigemeier

(10) Patent No.: US 10,213,792 B2
(45) Date of Patent: Feb. 26, 2019

(54) MODULAR FLOORSTANDING CENTRIFUGE

(71) Applicant: Thermo Electron LED GmbH, Langenselbold (DE)

(72) Inventor: Frank Eigemeier, Osterode-Dorste (DE)

(73) Assignee: Thermo Electron LED GmbH, Langenselbold (DE)

( * ) Notice: Subject to any disclaimer, the term of this patent is extended or adjusted under 35 U.S.C. 154(b) by 83 days.

(21) Appl. No.: 14/074,079

(22) Filed: Nov. 7, 2013

(65) Prior Publication Data

US 2014/0128240 A1 May 8, 2014

(30) Foreign Application Priority Data

Nov. 7, 2012 (DE) ..... 10 2012 021 986

(51) Int. Cl.
*B04B 7/02* (2006.01)
*B04B 7/06* (2006.01)

(52) U.S. Cl.
CPC ..... *B04B 7/06* (2013.01); *B04B 7/02* (2013.01); *Y10T 29/49826* (2015.01)

(58) Field of Classification Search
CPC ..... B04B 7/02; B04B 7/06; Y10T 29/49826; Y10T 29/49828
USPC ..... 494/12; 29/428, 429
See application file for complete search history.

(56) References Cited

U.S. PATENT DOCUMENTS 2,878,846 A * 3/1959 Marshall ..... B02C 18/00 241/85
2,917,229 A * 12/1959 Di Benedetto et al. ..... 494/14
3,240,425 A * 3/1966 Ray et al. ..... 494/10
3,347,453 A 10/1967 Goergen
4,226,669 A * 10/1980 Vilardi ..... B01D 3/08 159/44
5,855,545 A 1/1999 Kishi et al.
6,060,022 A * 5/2000 Pang et al. ..... 422/65

FOREIGN PATENT DOCUMENTS

JP 2005230745 A * 9/2005 ..... B04B 15/02

* cited by examiner

*Primary Examiner* — Walter D. Griffin
*Assistant Examiner* — Shuyi S. Liu
(74) *Attorney, Agent, or Firm* — Wood Herron & Evans LLP

(57) ABSTRACT

A modular floorstanding centrifuge comprising at least the following modules, the modules being preassembled, coherent components capable of being mounted as a whole, including a floor plate, a wall module adapted to be mounted on the floor plate together with two side wall elements capable of being attached to opposing edge regions of the floor plate, and a ceiling element adapted to interconnect the side wall elements, and a guard ring module adapted to be mounted on the wall module and comprising a guard ring attached to at least one side wall element and/or a ceiling element, wherein the ceiling element and the at least one side wall element are joined together and the at least one side wall element is mounted on the ceiling element such that it is capable of being attached to an edge region of the ceiling element pertaining to the underlying wall module.

10 Claims, 3 Drawing Sheets

FIG. 1
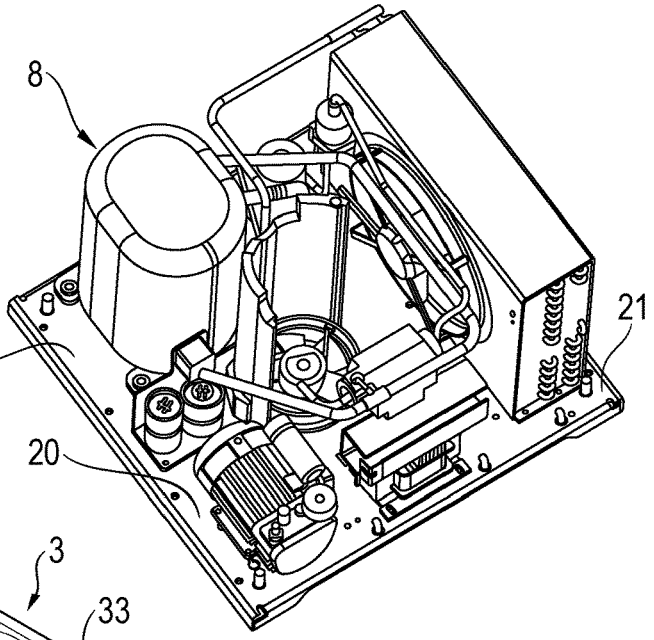
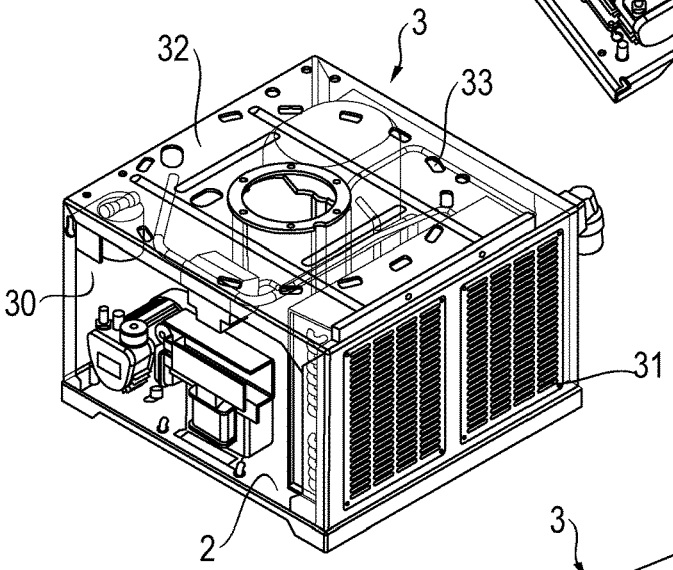
FIG. 2(a)
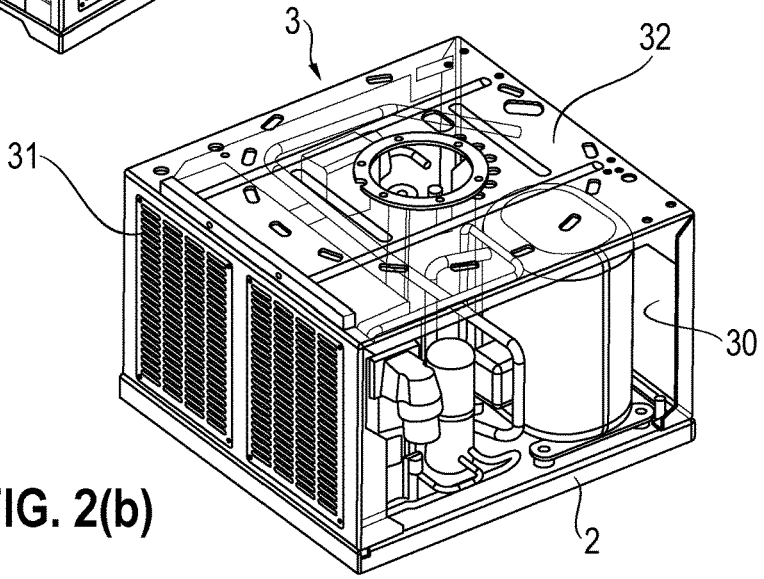
FIG. 2(b)

FIG. 3
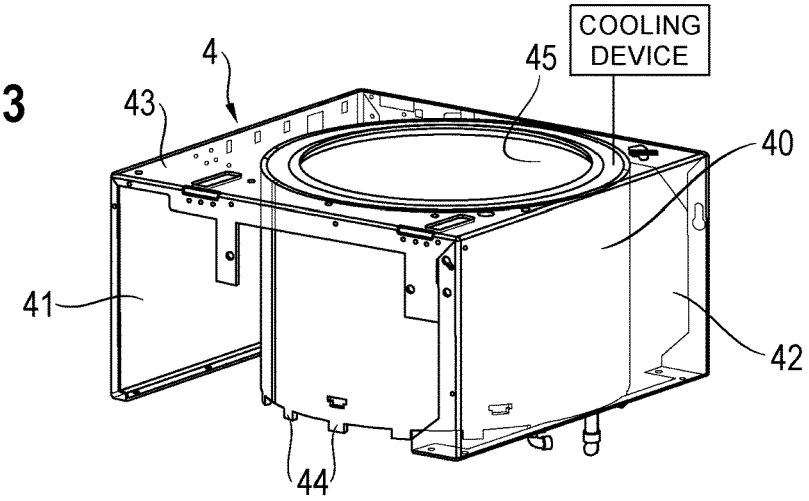
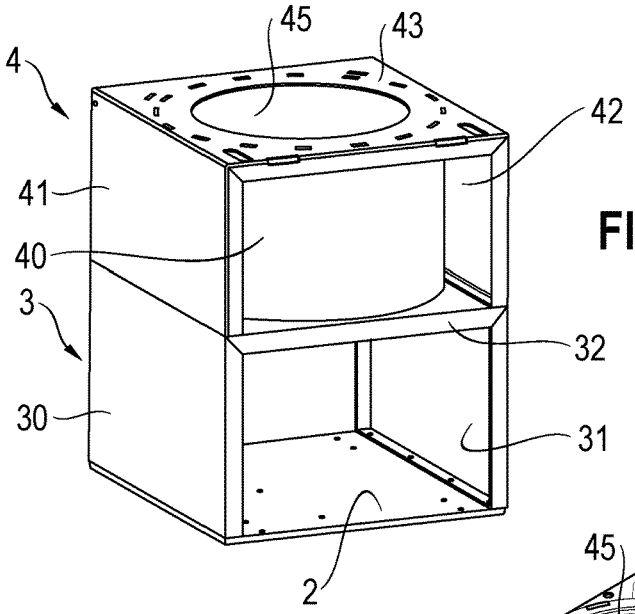
FIG. 4(a)
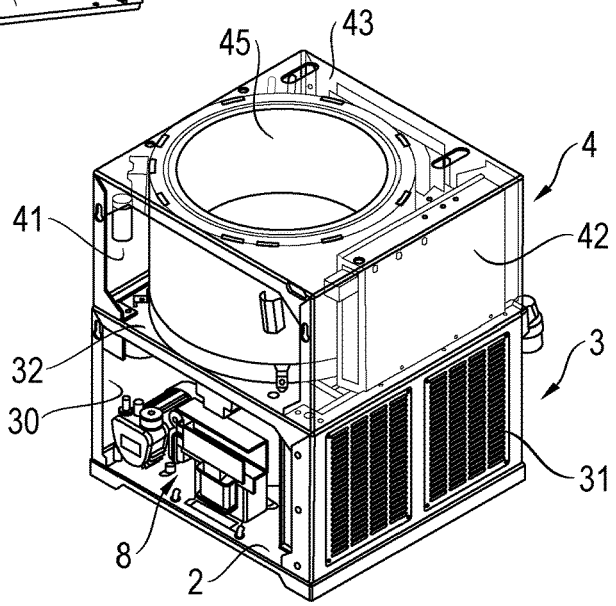
FIG. 4(b)

MODULAR FLOORSTANDING CENTRIFUGE

CROSS-REFERENCE TO RELATED APPLICATIONS

The present application claims priority under 35 U.S.C. § 119 of German Patent Application No. 10 2012 021 986.5, filed Nov. 7, 2012, the disclosure of which is hereby incorporated herein by reference in its entirety.

FIELD OF THE INVENTION

The present invention relates to a modular floorstanding centrifuge of a simpler design and capable of simpler and quicker assembly than floorstanding centrifuges of the prior art.

BACKGROUND OF THE INVENTION

Conventional floorstanding centrifuges usually have an undivided basic structure in which the device components are installed in a pre-fabricated cabinet. The installation of these components in the frequently multi-storied cabinet is often difficult and wearisome due to the relatively closed design of the cabinet. Not only during the assembly itself, but also when it is necessary to repair or replace defective components, does the closed cabinet-like housing construction prove to be a drawback due to the poor accessibility of the components disposed therein. Moreover, these circumstances are not conducive to achieving compact designs. Alternative constructions are also known, in which the floorstanding centrifuge comprises an inner, load-bearing skeletal chassis, which then necessitates encasement by the outer parts of the housing. However, this construction suffers from the drawback that it considerably increases the number of housing components and structural elements to be mounted. This not only raises the cost but also increases the assembly time. In addition, it is necessary to increase the accuracy with which the individual complex constituents are assembled.

There is thus a need for a floorstanding centrifuge, the assembly of which is less complex and less expensive than in the prior art. It is thus an object of the present invention to provide such a floorstanding centrifuge.

SUMMARY OF THE INVENTION

The present invention relates in its first aspect to a modular floorstanding centrifuge. The use of modules—by which are meant, in the present description, preassembled, coherent components capable of being mounted as a whole—considerably reduces the labor involved in assembling the floorstanding centrifuge, since it is only necessary to join the pre-fabricated modules to one another. On the other hand, the individual modules themselves can be fabricated in a very much simpler manner than a non-modular floorstanding centrifuge, since the modules are adapted such that they are much easier to access for attachment of the individual components than is the case with the cabinet-type or skeletal housing construction of the centrifuges of the prior art. As a rule, the number of individual components used can be reduced by the modular construction of the floorstanding centrifuge of the present invention. Likewise, the accessibility of defective components for purposes of repair work is improved over the prior art.

In detail, the modular floorstanding centrifuge of the present invention comprises at least the following modules: a floor plate, a wall module adapted to be mounted on said floor plate and comprising two side wall elements capable of being attached to opposing edge regions of said floor plate and further comprising a ceiling element for interconnecting said side wall elements, a guard ring module adapted to be mounted on said wall module and comprising a guard ring attached to at least one side wall element and/or to a ceiling element, wherein said ceiling element and said at least one side wall element are joined together and said at least one side wall element is mounted on said ceiling element such that it is capable of being attached to an edge region of the ceiling element pertaining to the underlying wall module.

The use of a floor plate as the first module has the advantage that it is freely accessible from above and from all sides and device components can be mounted thereon in a very simple manner. It is thus especially preferable, within the scope of the present invention, for these device components—which may, for example, be driving components for the rotor of the floorstanding centrifuge and/or a control device and/or an evacuator and/or a cooling device, or some other device components such as are conventionally employed in a floorstanding centrifuge—to be premounted on the floor plate before the other modules of the floorstanding centrifuge of the present invention are mounted. The at least partial encasement of the floor plate and thus of the lower region of the floorstanding centrifuge is thus preferably effected only after the desired device components have been mounted on the floor plate.

The at least partial encasement of the floor area of the floorstanding centrifuge then takes place, according to one embodiment of the present invention, by means of one module, namely the wall module, which comprises two side wall elements and a ceiling element adapted to interconnect the side wall elements. Thus, the wall module can have a substantially U-shaped cross-section, for example. The wall module is attached by means of the free ends of the side wall elements to the floor plate such that the edges of the side walls align with opposing edge regions of the floor plate. If desired, the wall module can additionally comprise at least one further side wall, with the result that it is encased either on three sides and at the top, or on all sides and at the top. In all cases, it is merely necessary to attach only one modular component to the floor plate.

A further module of the floorstanding centrifuge consists of a guard ring module that is designed to be mounted on the wall module and comprises a guard ring, which is attached to at least one side wall element and/or to a ceiling element of the guard ring module, for example, by means of screwing and/or welding. The ceiling element and the at least one side wall element are joined together such that the guard ring module again forms only one component, which considerably simplifies attachment thereof to the wall module. The at least one side wall element is attached to the ceiling element such that it is capable of being fixed to an edge region of the ceiling element pertaining to the underlying wall module. As in the case of the wall module, the guard ring module also preferably comprises two opposing side wall elements such that the walls of the guard ring module again preferably have a substantially U-shaped cross-section.

In a preferred embodiment, an inner tank is present in the guard ring, which inner tank in turn serves to accommodate a centrifuge rotor in a manner known per se. In addition, a cooling device may be advantageously disposed between the guard ring and the inner tank for the purpose of cooling the inner tank and the interior thereof.

Basically, it is thus possible to construct the floorstanding centrifuge of the present invention from only three modules, as far as the major portion of its essential operating components and housing elements is concerned. The centrifuge is completed by mounting only a few encasing elements or decorative elements, control elements, and/or display elements, or the like. Here again, the assembly can be simplified by the use, for example, of casing elements that are common to a plurality of modules. Thus, it is preferred, for example, to cover the wall module and the guard ring module with a common front panel and/or with a common rear wall. Finally, a device cover is advantageously fixed to the guard ring module.

Attachment of the modules to each other can be effected by any suitable fastening means. For example, one possibility involves attachment by means of screws and/or snap-on or plug-in connections. Positioning of the modules relatively to each other can be facilitated by the presence of complementary guide elements in adjacent modules to ensure the desired alignment of the modules relatively to each other. Examples thereof are guide pins that are caused to engage complementary centering holes in the adjacent module. Establishment of connections between, say, electrical conductors, supply lines, or drive cables or piping can be simplified in known manner by providing adjacent modules with complementary coupling elements, for example, in the form of pin-and-socket connectors, for the purpose of creating such connections.

BRIEF DESCRIPTION OF THE DRAWINGS

The present invention is explained in greater detail below with reference to the drawings. In the diagrammatic drawings, like reference signs denote like components. In the individual drawings:

FIG. 1 is a top view of a floor plate comprising mounted device components;

FIGS. 2(*a*) and 2(*b*) are views of the floor plate shown in FIG. 1 with a wall module mounted thereon;

FIG. 3 is a view of a guard ring module of the present invention;

FIG. 4(*a*) shows a floor plate, a wall module, and a guard ring module mounted in superposition;

FIG. 4(*b*) is a view of a floor plate which is equipped with device components and on which a wall module and a guard ring module are mounted;

FIG. 5(*b*) shows the floorstanding centrifuge as shown in FIG. 5(*a*) in a fully mounted state.

DETAILED DESCRIPTION OF THE INVENTION

Figure 5A:
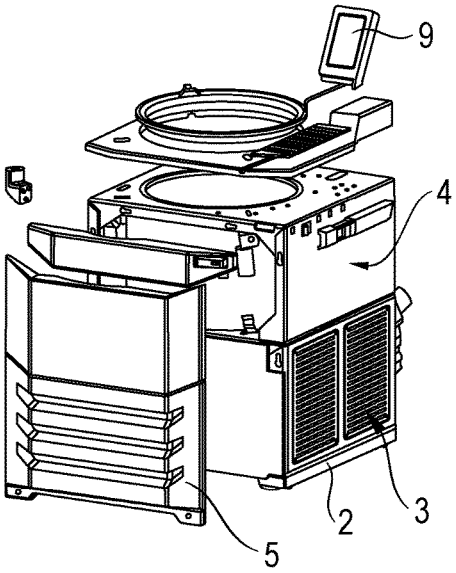
FIG. 5(*a*) is a partially exploded view of a floorstanding centrifuge without its cover.

FIG. 1 shows a floor plate 2 as the first module of a floorstanding centrifuge of the present invention. The floor plate 2 forms the bottom module of the floorstanding centrifuge. The figure is a top view of its top side, the underside remote from the observer being in contact with the floor. On the top side of the floor plate 2, there are mounted various device components 8. These device components may be, for example, drive components for driving the centrifuge rotor, a cooling device employed for the purpose of cooling the device components and/or the rotor chamber, an evacuator for evacuating the rotor chamber, control equipment, or the like. The components are denoted here not as individual entities, but collectively, by reference numeral 8, since they are all known per se. Mounting of the components 8 is a very simple procedure, since the floor plate 2 is readily accessible from all sides.

To the floor plate bearing, the premounted components 8 there is then attached a wall module 3. The mounted wall module 3 is visible in FIGS. 2(*a*) and 2(*b*). It consists of two side walls 30 and 31, which are interconnected so as to be joined directly by a ceiling element 32. Regarded in a cross-section taken at right angles to the side walls 30 and 31, the module 3 is substantially U-shaped. The wall module 3 is fixed to the floor plate 2 with the free ends of the side walls 30 and 31 oriented forwardly such that the front edges of the side walls 30 and 31 stand on the opposing edge regions 20 and 21 of the floor plate 2. Thus, the module 3 forms housing walls around the device components 8 and a floor surface for the guard ring module 4 to be attached to the wall module 3.

FIG. 3 shows this guard ring module 4. The guard ring module 4 comprises a guard ring 40, as is known per se, and serves to accommodate an inner tank 45, which in turn accommodates the centrifuge rotor. Between the guard ring 40 and the inner tank 45 there can be provided a cooling device for the purpose of cooling the interior of the inner tank. The guard ring 40 is affixed, for example, by welding, so as to be adjacent to an opening in the ceiling element 43. At opposing edges of the ceiling element 43, there extend side wall elements 41 and 42 to the side of the guard ring 40 and downwardly towards the wall module 3. The free front edges of the side wall elements 41 and 42 are fixed to the ceiling element 32 of the wall module 3 in prolongation of the side walls 30 and 31 of the wall module 3. For the purpose of positioning and securely attaching the guard ring module, and, more particularly, the guard ring 40, to the wall module 3, protrusions 44 are present on the guard ring at its lower edge, which protrusions are adapted to engage complementary openings 33 in the ceiling element 32 of the wall module 3.

FIGS. 4(*a*) and 4(*b*) show the floor plate, wall module and guard ring module mounted in superposition. FIG. 4(*a*) shows the floor plate 2 with no device components 8 mounted thereon. It is theoretically possible to install these device components on the floor plate 2 after the wall module 3 has been attached to the floor plate. However, it is preferable to use a floor plate 2 already equipped with device components 8, as illustrated in FIG. 1, since then the assembly of the components 8 can take place without interference from the walls 30, 31, and 32. The present invention makes it possible to produce a basic framework for a floorstanding centrifuge by fixing together only three modules with very little labor expenditure, in which case, a major part of the components essential for correct functioning of the centrifuge is already integrated and is surrounded at the top and bottom and on two sides by a housing.

Figure 5B:
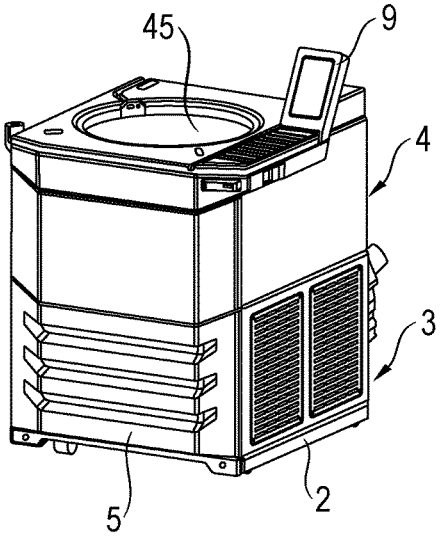
Figure 6A:
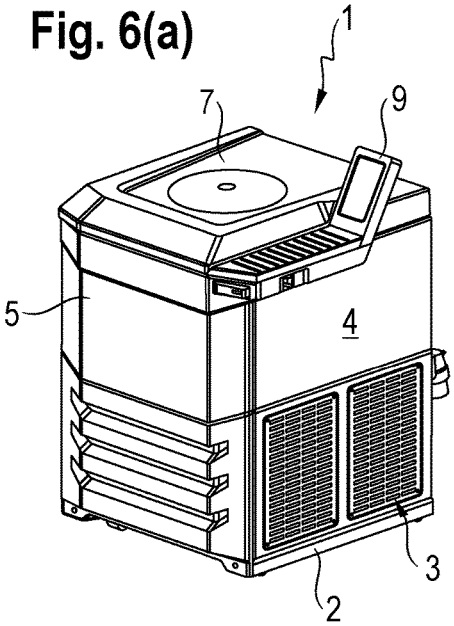
FIGS. 6(*a*) and 6(*b*) show a floorstanding centrifuge of the present invention in an oblique view from the front and an oblique view from the rear respectively.
Figure 6B:
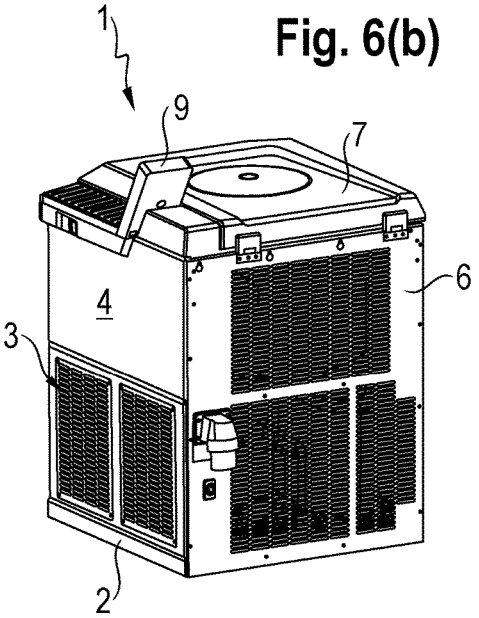

To conclude the assembly of the floorstanding centrifuge, it is merely necessary to mount only a few other components, such as, in particular, some casing elements, control elements and also, if desired, decorative elements. This is illustrated in FIGS. 5(*a*) and 5(*b*). In addition to some decorative and casing elements (not shown) in the region surrounding the inner tank 45, the elements to be additionally mounted are, more particularly, a front panel 5 to be installed on the front of the floorstanding centrifuge, and also dashboard elements 9. Furthermore, a rear wall 6 is to be mounted so as to extend across the wall module 3 and the guard ring module 4, as is visible in FIG. 6(*b*). FIGS. 6(*a*) and 6(*b*) show a finished mounted floorstanding centrifuge 1 of the present invention. To the top of the guard ring module 4, there is now attached a hinged device cover 7.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A modular floorstanding centrifuge, comprising:

a floor plate;

a wall module mounted on said floor plate and comprising two side wall elements attached to opposing edge regions of said floor plate and further comprising a ceiling element joined directly to said side wall elements; and a guard ring module mounted on and above said wall module and comprising a guard ring attached to at least one of a ceiling element and/or at least one side wall element of said guard ring module, wherein said ceiling element and said at least one side wall element of said guard ring module are joined together and are distinct from said ceiling element and said two side wall elements of said wall module, said at least one side wall element of said guard ring module being mounted on said ceiling element of said wall module such that said at least one side wall element of said guard ring module is attached to an edge region of said ceiling element of said underlying wall module.

2. A floorstanding centrifuge of claim 1, wherein driving components and optionally at least one of a control device, an evacuator, and a cooling device of said floorstanding centrifuge are premounted on said floor plate.

3. A floorstanding centrifuge of claim 1, wherein at least one further side wall element is attached to said ceiling element and said two side wall elements of said wall module.

4. A floorstanding centrifuge of claim 1, wherein said wall module and said guard ring module are encased by a common front panel and/or a common rear wall.

5. A floorstanding centrifuge of claim 1, wherein said guard ring module comprises two opposing side wall elements.

6. A floorstanding centrifuge of claim 1, wherein an inner tank is provided within said guard ring, and a cooling device is provided between said guard ring and said inner tank.

7. A floorstanding centrifuge of claim 1, wherein the floorstanding centrifuge comprises a device cover attached to said guard ring module.

8. A floorstanding centrifuge of claim 1, wherein adjacent modules comprise complementary guide elements for the purpose of positioning said modules relatively to each other.

9. A method for the fabrication of a floorstanding centrifuge of claim 1, comprising:

providing the floor plate, on which driving components and optionally at least one of a control device and a cooling device are premounted;

attaching the wall module to said floor plate by connecting the side wall elements to said floor plate; and attaching the guard ring module to said wall module by connecting at least one of the guard ring and said at least one side wall element to the ceiling element pertaining to said wall module.

10. The method of claim 9, further comprising:

attaching further side wall elements to said wall module and said guard ring module;

attaching a device cover; and attaching at least one of a control element, a display unit, and a casing element.

* * * * *